United States Patent [19]

Ulveling et al.

[11] 4,201,373

[45] May 6, 1980

[54] GUIDING AND POSITIONING MECHANISM FOR A PLUGGING OR DRILLING DEVICE

[75] Inventors: Léon Ulveling; Pierre Mailliet, both of Howald; Jean Metz, Pierret, all of Luxembourg

[73] Assignee: Paul Wurth-S.A., Luxembourg, Luxembourg

[21] Appl. No.: 943,228

[22] Filed: Sep. 18, 1978

[30] Foreign Application Priority Data

Jun. 1, 1978 [LU] Luxembourg ..... 79749

[51] Int. Cl.[2] ..... C21B 7/12

[52] U.S. Cl. ..... 266/271; 266/273

[58] Field of Search ..... 266/271, 272, 273, 45; 408/236, 237

[56] References Cited

U.S. PATENT DOCUMENTS

| | | | |
|---|---|---|---|
| 3,549,141 | 12/1970 | Zimmermann et al. | 266/273 |
| 3,765,663 | 10/1973 | Legille et al. | 266/273 |
| 4,097,033 | 6/1978 | Mailliet | 266/271 |

*Primary Examiner*—L. Dewayne Rutledge
*Assistant Examiner*—Peter K. Skiff

[57] ABSTRACT

A mechanism for guiding and positioning a workpiece of a machine for drilling or plugging a tap hole of a shaft furnace, the mechanism comprising a main pivot, a support arm which is rotatably mounted at one end on the main pivot, an intermediate arm having one end thereof pivotally fitted by an auxiliary pivot to the free end of the support arm, the auxiliary pivot being inclined with respect to the main pivot, a workpiece holding bar rotatably and adjustably mounted to the other end of the intermediate arm, said workpiece holding bar capable of having a workpiece mounted thereon, a guide rod pivotally mounted at one end to the intermediate arm and pivotally mounted at the other end to a fixed point in the vicinity of the main pivot, and a drive mechanism serving to pivot the workpiece and the support arm about the main pivot from a retracted position to an operational position, the workpiece being in angular adjustment with respect to the tap hole, the adjustment being performed by rotating the workpiece holding bar with respect to the intermediate arm. In one embodiment of the invention the inclination of the auxiliary pivot with respect to the main pivot is provided for by a fixed bend in the support arm. In another embodiment of the invention, the inclination of the auxiliary pivot is provided for by a support arm having two segments, one segment being hinged and angularly adjustable with respect to the other segment.

11 Claims, 16 Drawing Figures

GUIDING AND POSITIONING MECHANISM FOR A PLUGGING OR DRILLING DEVICE

The present invention relates to a guiding and positioning mechanism for the working tool of a machine for drilling or plugging the taphole of a shaft furnace, comprising a tool holder bar mounted at one end of a stem of which the other end is movable about a main pivot, as well as a driving means serving to pivot the assembly consisting of stem, bar and working tool about the main pivot, from a retracted position to a working position and vice versa, the stem consisting of a supporting arm and a guide bar.

The present tendency is to give the tapholes a relatively steep gradient, i.e. to drill the tapholes at an angle which is generally above 8°. The operating position of the drill accordingly has to be slanting, and the mechanism by which it is moved must be designed to cause it to assume this angle of inclination in respect of the horizontal. This condition, on the other hand, does not have to be fulfilled so rigorously by the machine for plugging the taphole.

A further requirement which has to be satisfied by a machine of the kind defined above is that it must be situated as low down as possible when in its position of rest. It is also preferable that in the said position of rest the tool holder bar should be horizontal, so that its tip does not point upwards and so that a hole will not have to be made in the pouring floor to accomodate the rear part of the bar. These requirements regarding a low horizontal position for the bar when retracted are due to the need for easy access for maintenance purposes or are a direct result of the design of the installation. In a system such as that proposed by Luxemburg Pat. No. 78209, for example, where the plugging device and the drill are juxtaposed on one and the same side of the tap spout and the clay gun passes over the drill when being moved between its retracted position and its operative position, steps have to be taken to ensure that the drill, in its retracted position, will not impede the movement of the clay gun.

Apart from these requirements regarding the retracted position and the operating position, certain conditions also have to be fulfilled by the path followed by the tool in moving from one position to the other. The fact is that as the tap spout is defined laterally by two flanks which may exceed, in height, both the floor of the cast house and the axis of the taphole the traject of the working tool must be such that when being moved to the operative position it can be lifted over one of these two flanks, so that it can then be thrust obliquely in the direction of the taphole to be drilled or to be stopped up, and vice versa during the opposite movement. Furthermore, the trajectory must be such that the nose of the working tool, during its movement, will not knock against the internal surface of either of the lateral flanks of the tap spout.

On the other hand it is equally desirable that the working tool should follow a relatively low trajectory between its two positions, in order not to form an obstacle for the working platform which is provided around the furnace and which is required to be sufficiently wide and without any break a the point where the taphole is situated.

Up to the present the drill or the clay gun have been given the required angle of inclination, when in the operative position, by inclining the main pivot in the direction of the furnace by an angle largely equal to the angle of inclination of the taphole, in other words, by moving the drill or the clay gun in an oblique plane situated in the prolongation of the axis of the taphole. An example of such a machine is described in U.S. Pat. No. 4,097,033.

It is only in exceptional cases, however, that machines of this kind can satisfy all the requirements enumerated above. The fact is that either the conditions required for the trajectory and for the operative position can be fulfilled, in which case the working tool in its retracted position is too high up or is inclined at an excessive angle, which renders the machine unsuitable for the system in which the drill and the plugging device are combined together, as proposed in Luxembourg Pat. No. 78209, or else the conditions for the retracted position can be satisfied, in which case it is generally impossible to raise the working tool above the sides of the tap spout.

The purpose of the present invention is to enable a mechanism of the type described above to be improved in such a way as to eliminate these drawbacks while at the same time retaining the advantages achieved, in other words to provide a guiding and positioning mechanism for the working tool which will not form an obstacle for the working platform, and vice versa, and which will not knock against the sides of the tap spout, while at the same time enabling the taphole to be inclined at the angle required, occupying a low retracted position, largely horizontal and easily accessible, and movable between the two extreme positions over a trajectory enabling it to be manoeuvered between the obstacles present thereon.

According to the present invention there is provided a mechanism for guiding and positioning the working tool of a machine for drilling or plugging the taphole of a shaft furnace, comprising a tool holder bar mounted at one end of a stem of which the other end is movable about a main pivot, said stem consisting of a supporting arm and a guide bar, a driving means serving to pivot the assembly consisting of stem, bar and working tool about the main pivot, from a retracted position to a working position and vice versa, as well as an intermediate arm provided between the supporting arm and the guide rod, on the one hand, and the tool holder bar, on the other, the connection between the intermediate arm and the supporting arm being provided by means of an auxiliary pivot of which the longitudinal axis is oblique in relation to the longitudinal axis of the main pivot, while the connection between the intermediate arm and the tool holder bar is rigid and adjustable, the adjustment being performed by tilting the bar about the longitudinal axis of the intermediate arm.

In one particular embodiment of the invention this displacement mechanism may take the form of an approximate parallelogram so designed that the tool holder bar is turned over into position largely parallel to the supporting arm and to the guide bar when these latter have been pivoted through an angle of 90° from the operative position. In another advantageous embodiment of the invention the apparatus may be so arranged that in the operative position the longitudinal axis of the intermediate piece is situated in a plane defined by the longitudinal axis of the supporting arm and the longitudinal axis of the main pivot, while the retracted position is offset by an angle of 90° in relation thereto, i.e. the axis of the intermediate piece assumes a direction transversal to the aforementioned plane and the tool holder bar is turned back into a position largely parallel to the supporting arm. Although this is the least obstructive retracted position, the latter can be selected away from the 90° offset position, either on the near side or on the far side thereof, according to the requirements arising and the space available.

During its movement from the operative position to the retracted position and vice versa the supporting arm moves in a first plane about the main pivot, this first plane being inclined if the main pivot is inclined, while the tool holder bar and the intermediate piece pivot about the auxiliary pivot in different inclined plane, owing to the fact that the axes of the main pivot and auxiliary pivot are not parallel.

In a first embodiment of the invention it is only in one single direction that the auxiliary pivot is inclined in respect of the main pivot, this direction lying in the plane defined by the longitudinal axis of the supporting arm and the longitudinal axis of the main pivot. The tool holder bar is therefore inclined by a corresponding angle in respect of the horizontal when it has been turned over into a plane parallel to the supporting arm and particularly when this position corresponds to its retracted position. In order to ensure that in this position the bar will nevertheless be horizontal it is sufficient to adjust it by tilting it about the axis of the intermediate piece. The inclination of the auxiliary pivot and the adjustment of the tool holder bar about the axis of the intermediate piece therefore have opposite effects on the inclination of the bar, and the result may be that the latter is horizontal when the effect of its adjustment exactly counteracts the effect of the inclination of the auxiliary pivot and any inclination to which the main pivot has been subjected.

If from an adjusted position as defined above, the tool holder bar is moved to the operative position, the effect of the inclination of the auxiliary pivot on the inclination of the bar in respect the horizontal, decreases progressively and becomes zero when the bar is perpendicular to the supporting arm. If this corresponds to the operative position the bar will consequently be inclined in respect to the horizontal by an angle determined by the degree of the prior adjustment of the bar in the retracted position and possibly by the inclination of the main pivot in the direction of the furnace. The angles of inclination of the auxiliary pivot and of the main pivot will thus be selected in accordance with the inclination of the tap spout.

In addition to the aforementioned inclination of the main pivot in a direction situated in a first plane it can be given a supplementary inclination in a second plane perpendicular to the first. Owing to this inclination, of which the magnitude will depend on the requirements arising, the auxiliary pivot will likewise be inclined towards the furnace when in the operative position. The effect of this supplementary inclination of the auxiliary pivot is naturally transmitted to the working tool, of which the inclination in respect of the horizontal will increase by a corresponding angle.

According to one particular characteristic of the invention, the inclination of the auxiliary pivot in respect to that of the main pivot can be regulated. This adjustment can be effected by means of a hinge incorporated in the supporting arm and forming a kind of universal joint in conjunction with the auxiliary pivot. The angle of this hinge will be adjustable either manually or by means of a hydraulic jack. It will enable the working tool to be moved to different angles of inclination, in the operative position, while at the same time preserving the low horizontal position for when it is retracted. This characteristic even makes it possible to give the tool a "negative" angle of inclination, i.e. to adopt a taphole taking an ascending course. This may be of great advantage when a reserve taphole is required at a higher level when owing to cooling, the top of the liquid phase has moved higher up in the furnace. Up to the present a taphole of this kind has generally been drilled by hand.

The mechanism covered by the present invention is particularly suitable, in a compact drilling installation according to Luxembourg Pat. 78.209 for whichever of the two machines is closer to the tap spout. This is generally the drilling machine but might equally well be the plugging apparatus.

The present invention may be better understood and its numerous objects and advantages will become apparent to those skilled in the art by reference to the accompanying drawings wherein like reference numerals refer to like elements in the several figures and in which.

For the sake of simplicity the following detailed description will refer to a drilling machine. It is nevertheless obvious that the invention may equally well be applied to a plugging apparatus. All that is necessary is to imagine that the drill bar is replaced by a clay gun.

Similarly, to render the description more explicit and comprehensible, it will refer to the particular case of a machine of which the guiding and displacement mechanism takes the form of a parallelogram.

Figure 1:
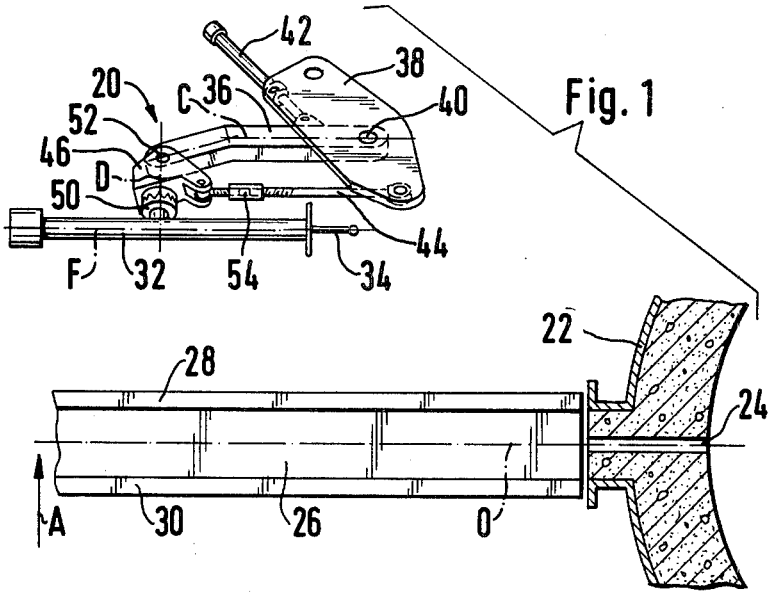
FIGS. 1 and 2 are general plan views of a machine according to the invention, in the retracted position and in the operative position respectively.
Figure 2:
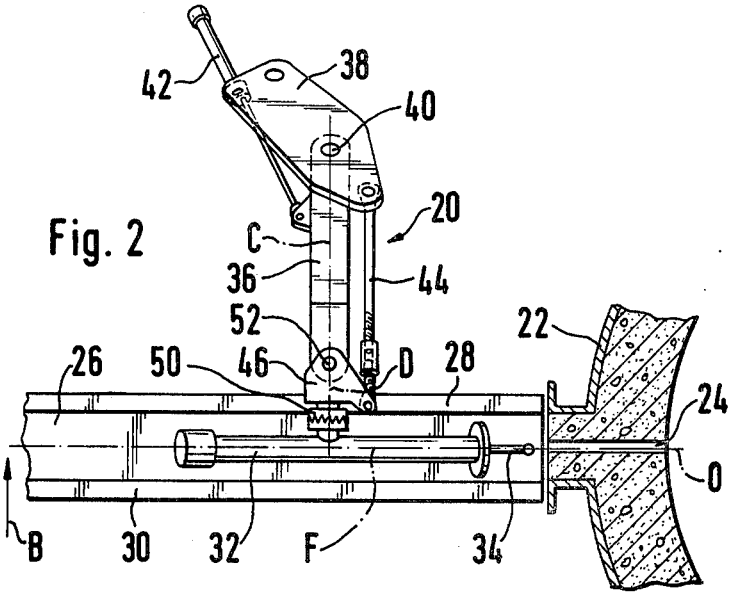

FIGS. 1 and 2 show, partially and as a horizontal section, the wall 22 of a shaft furnace, in which a taphole 24 has been shown schematically, this hole having been drilled with a drill marked 20 as a whole and shown in FIGS. 1 and 2, in the retracted position and in the operative position respectively.

The taphole 24 is prolonged outside a furnace by a tap spout 26 installed in the cast house and delimited laterally by the vertical or oblique flanks 28 and 30.

The drill 20, as a whole, is analogous to that described in U.S. Pat. No. 4,097,033, thus comprising a tool holder bar 32 with a working tool consisting in this case of a drill bit 34, these items being mounted at one end of a supporting arm 36 of which the other end is mounted on a main pivot 40 accommodated in a support 38, on which is likewise mounted a hydraulic jack 42 serving to pivot the arm 36 about its pivot 40, between the two positions shown respectively in FIGS. 1 and 2. In addition to the supporting arm 36 the apparatus includes, as in the aforementioned previous patent, a guide rod 44 of which the purpose is to guide the movement of the tool holder bar 32.

Contrary to the drill described in U.S. Pat. No. 4,097,033, however, the tool holder bar 32 is not mounted on the actual end of the supporting arm 36 and of the guide rod 44, and it is one of the essential characteristics of the present invention that the tool holder bar 32 is borne by an intermediate arm 46, this latter being articulated to the end of the supporting arm 36 and of the guide rod 44. The connection between the supporting arm 46 and the bar 32, while being rigid, is adjustable in a manner known per se, e.g. by the connection between the tool holder bar and the supporting arm in U.S. Pat. No. 4,097,033 in which this connection is provided by means of cheeks with a lateral system of teeth.

For the purposes of the explanations given hereinafter the diagrams contain the axes of the essential elements. The reference letter C marks the longitudinal axis of the supporting arm 36, while D refers to the axis of the intermediate arm 46, this axis passing through the centre of the adjustable securing system 50 between the intermediate arm 46 and the tool holder bar 32, the reference letter F marking the longitudinal axis of the said bar 32. This axis F is situated in the prolongation of the axis of the drill bit 34 and, in the operative position, in the prolongation of the axis 0 of the taphole 24.

The fact that the guide bar 44 and the supporting arm 36 are situated parallel to each other is not an essential feature of the invention, since they could equally well slant in relation to each other and thus form a kind of pseudo-parallelogram instead of a parallelogram. Similarly, the operative position need not necessarily be defined by a perpendicular orientation of the supporting arm 36 in relation to the tap spout 26, and this supporting arm 36, in the retracted position, likewise need not necessarily be parallel to the said tap spout 26. These various positions, as well as the pivoting angle between the retracted position and the operative position, will be defined in accordance with each type of installation and the space available around the tap spout 26. In order to simplify the following description and render it more easily comprehensible, however, reference will be made to the particular example shown in FIGS. 1 and 2. It nevertheless remains valid for other arrangements and methods of assembly within the scope of the invention.

In the example described the main pivot 40 is inclined with respect to a vertical plane which includes the axis 0 of the taphole, with the upper end of pivot 40 being further from the tap spout than the lower end of pivot 40.

It is possible that this main pivot 40 will also be inclined by a few degrees in a second direction. It will then lean either in the direction of the furnace or the opposite direction. The choice and amplitude of these angles of inclination will depend on the conditions to be fulfilled by the path of supporting arm 36 and that of the tool holder bar 32 and the drill bit 34. The particular circumstances in which the main pivot is vertical are likewise possible.

Figure 3:
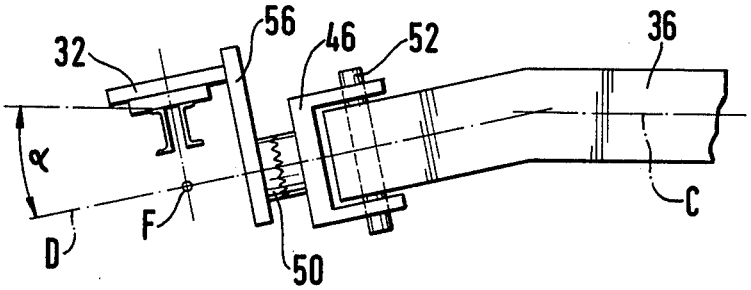
FIGS. 3 and 4 show the end of the supporting arm with the auxiliary pivot, at two different angles of inclination, viewed along the axis of the tool holder bar.
Figure 4:
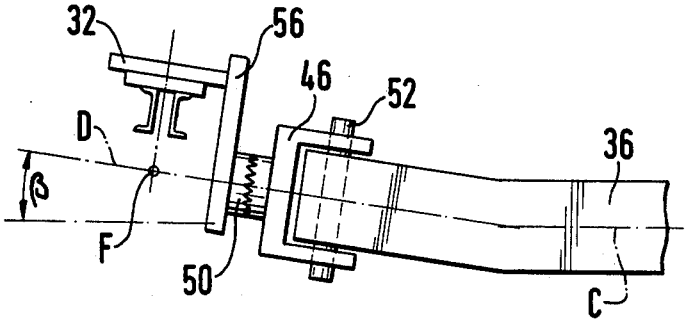

The articulation between the intermediate arm 46 and the supporting arm 36 is obtained by means of an auxiliary pivot 52 (see also FIGS. 3 and 4). According to another essential characteristic of the invention this pivot 52 and consequently the intermediate arm 46 with the tool holder bar 32 and the drill bit 34 are inclined in relation to the supporting arm 36. In a first version the auxiliary pivot 52 is inclined in one single direction (FIGS. 3 and 4) in a plane defined by the axis C of the supporting arm 36 and the axis of the main pivot 40.

When the drill is moved by means of a jack 42 between the two positions shown in FIGS. 1 and 2 a pivoting movement of the tool holder arm 32 and of the intermediate arm 46 about the auxiliary pivot 52 becomes superimposed on the pivoting movement of the entire assembly about the main pivot 40. The said superimposed pivoting movement is caused by the presence of the guide bar 44. This auxiliary pivoting movement transfers the tool holder bar 32 from a position substantially perpendicular to the supporting arm 36 in the operative position to one which is substantially parallel to the supporting arm 36 in the retracted position, and vice versa. It should be noted, however, that the orientations shown in FIGS. 1 and 2 for the tool holder bar in respect of the supporting arm can be altered by regulating the length of the guide bar 44, this regulating operation being easily carried out by means of a tension screw or turnbuckle 54 (FIG. 1).

Owing to the inclination of the main pivot 40 and above all the different inclination of the auxiliary pivot 52 the pivoting movement of the tool holder bar 32 about its pivot 52 sweeps a first plane about this movable pivot taken as a reference, while the entire assembly sweeps a different plane about the main fixed pivot 40. This results in a very complex trajectory for the tool holder bar 32 and the end of the drill bit 34, of which trajectory the coordinates are determined by the amplitude and the direction of the inclinations of the two pivots 40 and 42 and possibly by the length of the guide bar 44.

To enable more complete control to be exercised over the parameters of the trajectory of the drill bit 34 the latter should preferably occupy an axial position in relation to the intermediate arm 46, i.e. the axis F and the axis D should preferably intersect at a given point. For this purpose, as shown in FIGS. 3 and 4, a supplementary piece 56 must be provided between the tool holder bar 32 and the intermediate arm 46, or else the latter must be constructed to a suitable shape in order to raise the tool holder bar 32 in relation to the axis D.

As may be seen from FIGS. 3 and 4 the simplest means of obtaining the auxiliary inclination for the auxiliary pivot 52 is to provide a bend in the supporting arm 36. As shown by FIG. 3, a bend of this kind results in an angle of inclination $\alpha$ between the axis D of the intermediate arm 46 and the axis C of the supporting arm. According to the particular installation concerned and for reasons explained in greater detail hereinafter, this bend may either lower the tool holder bar 32, as shown in FIG. 3, or raise it, as shown in FIG. 4.

Figure 5:
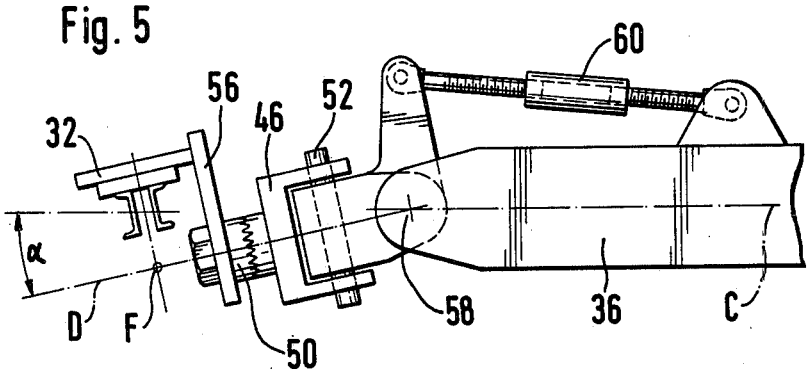
FIGS. 5 and 6 show views corresponding to FIGS. 3 and 4 respectively, the supporting arm comprising a hinge serving to incline the auxiliary pivot.
Figure 6:
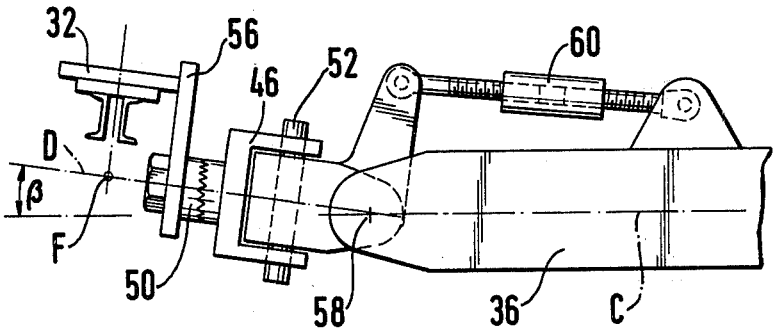

FIGS. 5 and 6 show advantageous variants of the assemblies shown in FIGS. 3 and 4 respectively, these variants being obtained by providing the supporting arm 36 with a hinge 58 enabling a bend with a variable angle to be obtained. The axis of this hinge 58 is perpendicular to the axis of the pivot 52, so that the assembly consisting of the hinge 58 and pivot 52 may be compared to a universal joint. The angle of the hinge 58 can be regulated by means known per se, the simplest being that shown in FIGS. 5 and 6 and consisting of a tension screw 60. By regulating this tension screw manually a progressive adjustment may be effected between a "descending" angle such as that shown in FIG. 5 and "ascending" angle such as that shown in FIG. 6. Needless to say, the tension screw 60 can be replaced by a more sophisticated device, such as a hydraulic jack.

Figure 7:
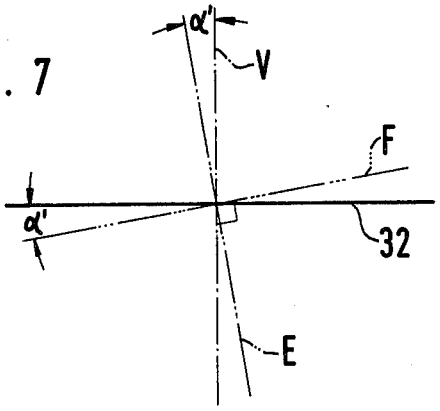
FIGS. 7 and 8 are schematic diagrams of the inclination of the tool holder bar, in the direction shown by the arrows A and B in FIGS. 1 and 2 respectively, and corresponding to the angles of inclination of the auxiliary pivot as shown in FIGS. 3 or 5.

A more detailed description will now be given, by reference to the subsequent diagrams, of the effects exerted by the bend in the supporting arm 36 on the positions of the tool holder bar 32 and also on the trajectories covered by the latter and by the drill bit 34. Without the bend in the supporting arm 36, i.e. with an auxiliary pivot 52 parallel to the main pivot, the axis F would still occupy the same plane as the axis C of the supporting arm 36 or a plane parallel to the latter. Assuming, therefore, that the main pivot 40 is inclined in such a way that the supporting arm, in its retracted position, is substantially horizontal, the two axes F and C would lie in the same horizontal plane in FIG. 7, which is a view of the drill in the direction shown by the arrow A of FIG. 1. However, the presence of a bend in the supporting arm 36 will lead, in the retracted position shown in FIG. 1, to an inclination of the axis F in respect of the horizontal, assuming that the securing system 50 remains unchanged in relation to the arrangement envisaged in the foregoing. FIG. 7 is a schematic diagram of this arrangement, in which the axis E of the auxiliary pivot 52 forms an angle $\alpha'$ with the vertical, in accordance with the version shown in FIGS. 3 and 5. Under these circumstances the axis F would likewise form an angle $\alpha'$ in respect of the horizontal, the tip of the drill 24 pointing into the air. However, the adjustable securing device 50 enables the tool holder bar, by means of a rotation through an angle $\alpha'$ around the axis D of the intermediate piece 46, to be returned to a horizontal position, this being shown by the thick line 32 in FIG. 7.

When the tool holder bar is displaced from the retracted position to the operative position shown in FIG. 2 the effect of the inclination of the auxiliary pivot 52 on the inclination of the tool holder bar 32 decreases progressively, disappearing completely when the position shown in FIG. 2 is reached. These circumstances are illustrated schematically by FIG. 8, where the axis E of the auxiliary pivot 52 coincides with the vertical. The reason is that the auxiliary pivot 52 is only inclined in one single direction, i.e. in the plane passing through the axis of the main pivot 40 and the axis 0 of the supporting arm, shown by the vertical line in FIG. 8. Consequently, it is only the adjustment of the variable securing device 50 that determines the angle of inclination of the tool holder bar 32 in the operative position. This adjustable securing device 50 having been set to the angle $\alpha'$, as described in the foregoing, the tool holder bar will be inclined by an angle $\alpha'$ in respect of the horizontal in the operative position, this being shown by the full line in FIG. 8. The runner will thus be drilled at an angle $\alpha'$.

Figure 11:
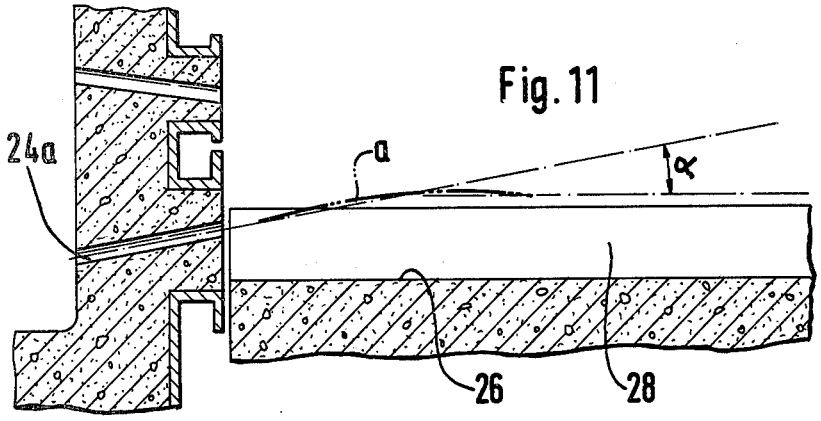
FIGS. 11 and 12 are schematic diagrams of the trajectory followed by the nose of the working tool, being an elevation and a plan view respectively and corresponding to the version shown in FIGS. 7 and 8.
Figure 12:
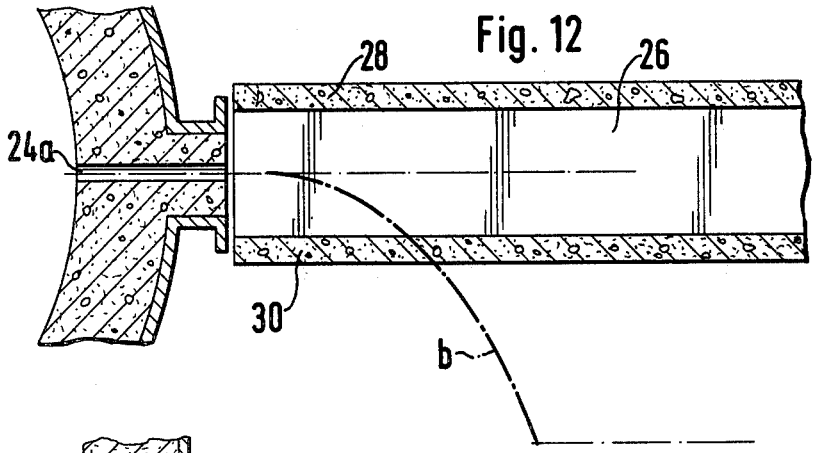

In other words, in the retracted position the effects of the inclination of the auxiliary pivot 52 and of the adjustment by means of the securing device 50 to the inclination of the tool holder bar take the opposite direction to each other and the said tool holder bar will be inclined at an angle equal to the difference between the said effects. On the other hand, in the operative position the effect of the inclination of the auxiliary pivot 52 on the inclination of the tool holder bar is cancelled out and the latter will be inclined at an angle equal to the angle by which the securing device 50 is adjusted. The mechanism described therefore enables the drill to be moved from a low horizontal position to one in which it is inclined at a greater or smaller angle according to requirements, and vice versa. FIGS. 11 and 12 show two curves which represent, in elevation in FIG. 11 and as a plan view in FIG. 12, respectively, the trajectory covered by the end of the drill bit 34 during the movement between the two positions shown in FIGS. 1 and 2, for an angle of inclination $\alpha$ of the auxiliary pivot 52, in accordance with FIGS. 3,5,7 and 8. According to the curve "a" in FIG. 11 it may be seen that when the machine is returned from the operative position to the retracted position the drill bit is rapidly raised in accordance with a gradient at least equal to the angle $\alpha$ of the tap spout 26. The maximum height of the curve will be reached approximately at the point where the drill bit leaves the tap spout 26 above the flank 30. The curve then once again flattens out until the retracted position is reached. The curve "b" in FIG. 12 shows that as long as the drill bit 34 is situated in the tap spout 26, i.e. as long as the curve "a" in FIG. 11 is lower than the top of the flank 30, the curve "b" takes its course in the central region of the tap spout 26. There is thus no risk that the drill bit 34 will knock against either of the flanks 28 and 30.

Figure 8:
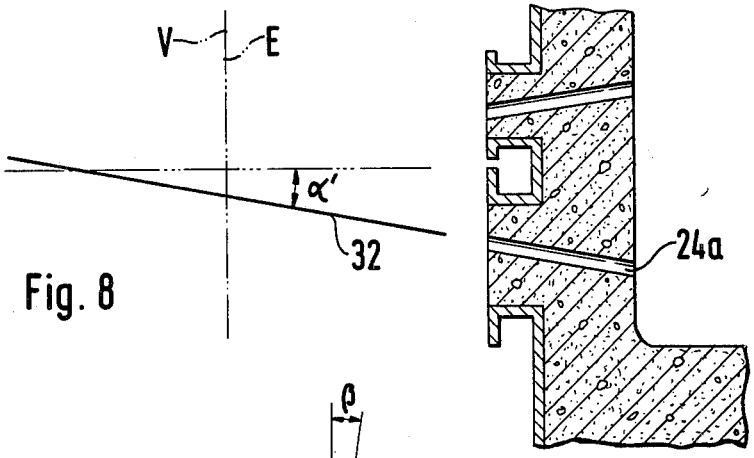

The foregoing reasoning, based on FIGS. 7 and 8, can also be applied to the embodiments shown in FIGS. 4 and 6, where the bend in the supporting arm 36 takes the opposite direction. The axis E of the auxiliary pivot, in the retracted position shown in FIG. 1, and viewed in the direction shown by the arrow A, forms an angle $\beta$ in respect of the vertical, this being shown in FIG. 9. In order to ensure that the tool holder bar will nevertheless occupy a horizontal position the variable securing 50 must be adjusted by a corresponding angle $\beta$ in order to cancel the effect of the inclination of the axis E. This is likewise shown in FIG. 9.

Figure 10:
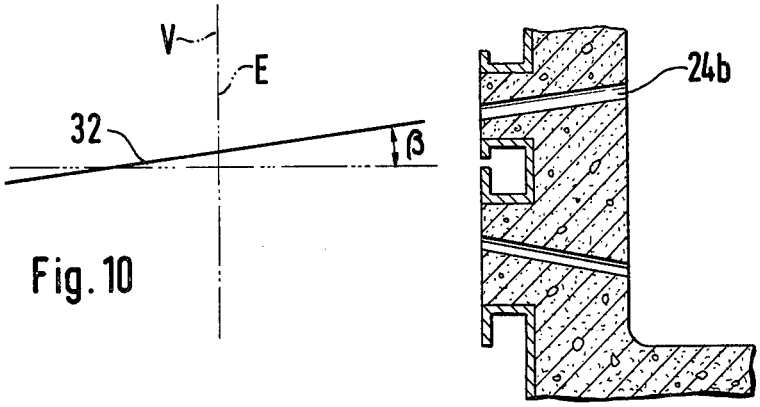

As in the previous case, the movement of the machine from the retracted position to the operative position, as shown in FIG. 2, cancels the effect of the inclination of the auxiliary pivot 52, so that in the operative position the tool holder bar is inclined by an angle $\beta$ corresponding to that by which the securing device 50 was adjusted. This is shown in FIG. 10 by the thick line representing the tool holder bar 32. This FIG. 10 consequently proves that with the same initial conditions, i.e. with the same inclination for the main pivot 40 and the same retracted position of the supporting arm 36, it is possible to drill either a taphole 24a with a descending gradient towards the interior of the furnace, as shown in FIG. 8, or a taphole **24*b* with an ascending gradient, as shown in FIG. 10, according to whether the auxiliary pivot 52 is inclined as shown in FIG. 3 or as shown in FIG. 4. This brings out with particular clarity the advantages offered by the version shown in FIGS. 5 and 6, in which the inclination of the auxiliary pivot 52 is adjustable. In other words, by simply regulating the tension screw 60**, the same machine can be used, if necessary, to drill a reserve taphole at a higher level, whereas up to the present this hole had to be drilled manually, the operator thus being exposed to the risk of accidents.

Figure 9:
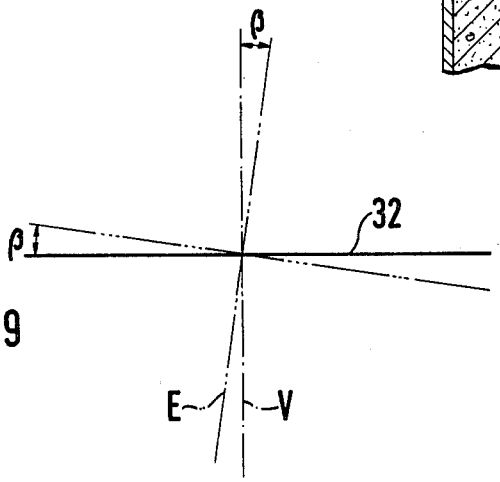
FIGS. 9 and 10 are schematic views analogous to those provided by FIGS. 7 and 8 but with the auxiliary pivot inclined at angles corresponding to FIGS. 4 or 6.
Figure 13:
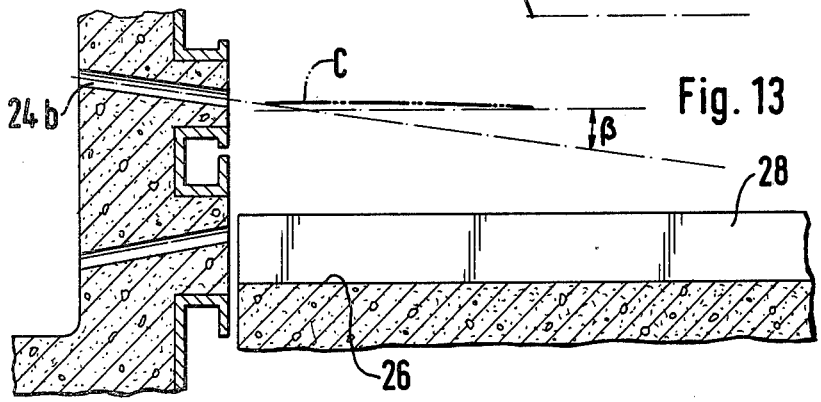
FIGS. 13 and 14 are an elevation and plan view, respectively, of the trajectory followed by the nose of the working tool for an assembly corresponding to that shown in FIGS. 9 and 10.
Figure 14:
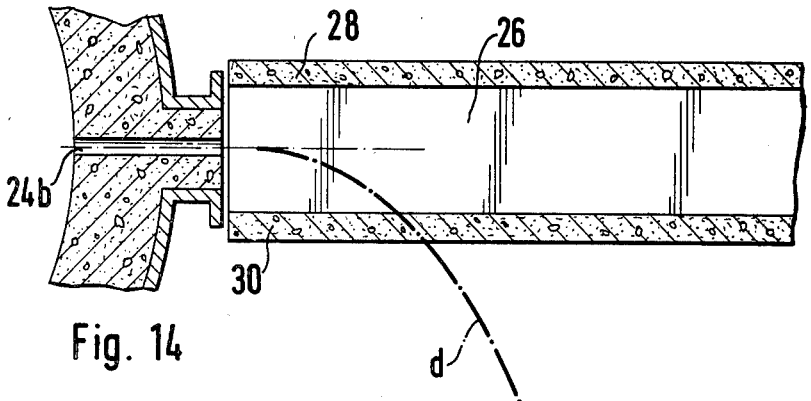

The curves "c" and "d" in FIGS. 13 and 14 indicate the path followed by the end of the drill bit 34 when being moved between the two extreme positions of FIGS. 1 and 2 and for the conditions illustrated in FIGS. 9 and 10. The curve "c" is of particular interest since it shows that even though the tool holderbar is inclined by an angle $\beta$ in the operative position and is approximately horizontal in the position of rest the trajectory followed by the drill bit 34 is more or less a horizontal one. In other words, the combined effect of the rotations about the inclined pivots 40 and 52 lowers the rear part of the tool holder bar as and when the latter is moved nearer to the operative position or causes the said rear part to reascend as and when the said tool holder bar is returned to the retracted position.

It should be noted that the course followed by the movements described in the foregoing, particularly by reference to FIGS. 7 to 14, applies to certain assumed starting conditions, i.e. those illustrated in FIGS. 1 and 2, with one particular angle of inclination for the main pivot 40. If one or other of these starting conditions varies, then both the traject and the inclination of the tool holder bar in the operative position will be affected accordingly. It is possible, for example, that with a different inclination for the main pivot 40 from that on which the foregoing explanations are based a supporting arm 36 bent as shown in FIG. 4 will be required in order to reach an operative position such as that shown in FIG. 8 or that an arm bent in accordance with FIG. 3 will be required in order to move the tool holder bar into the operative position shown in FIG. 10.

If these various parameters are not yet sufficient to enable the machine to function in an optimum manner, even under exceptional conditions, the auxiliary pivot 52 can be inclined in a second plane perpendicular to the plane of inclination shown in FIGS. 3 and 4, i.e. in a plane perpendicular to that of these said drawings, FIGS. 3 and 4.

Figure 15:
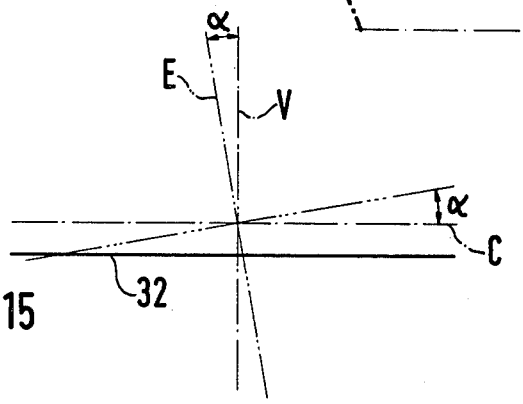
FIGS. 15 and 16 are schematic views, analogous to those of FIGS. 7 and 8, for an auxiliary pivot inclined in two directions.
Figure 16:
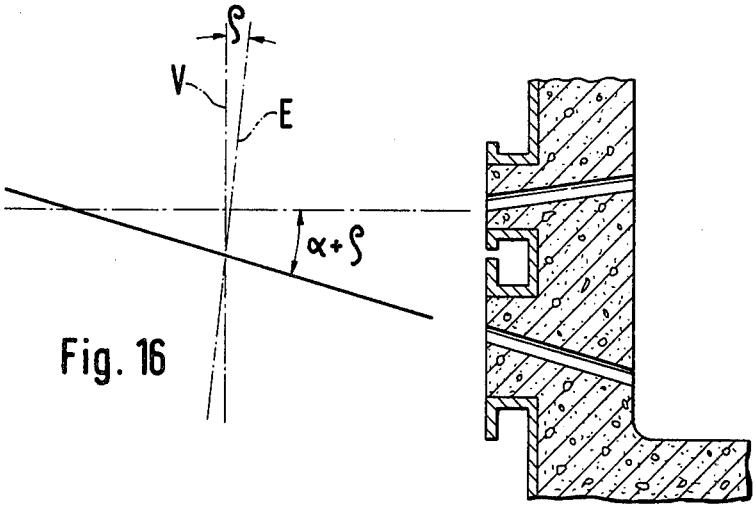

FIGS. 15 and 16 illustrate this possibility schematically. According to these diagrams the inclination $\alpha$ of the axis E of the auxiliary pivot in a first direction still applies, as described above, while a second inclination by an angle $\rho$, in a direction perpendicular thereto, is added. Again applying the foregoing reasoning by reference to the previous diagrams and referring to FIGS. 1 and 15 in conjunction with each other, on the one hand, and FIGS. 2 and 16 in conjunction with each other, on the other hand, it may be seen that the angle $\rho$ has no effect on the inclination of the tool holder bar 32 in the retracted position shown in FIGS. 1 and 15, since the said angle $\rho$ corresponds to the inclination of the axis E in a direction perpendicular to FIG. 15. As before, it is only the angle $\alpha$ between the axis E and the vertical that is visible, this angle being compensated by a corresponding rotation of the tool holder bar 32 by means of the adjustable securing device 50, in order to return the said tool holder bar to the horizontal position. However, owing to this supplementary inclination of the axis E the tool holder bar 32 will be situated lower down than the axis C of the supporting arm 36, while nevertheless remaining parallel. The amplitude of this gap between the axis C and the tool holder bar 32, illustrated in FIG. 15, obviously depends on the value of the angle $\rho$.

As and when the drill is pivoted from the retracted position shown in FIG. 1 to the operative position shown in FIG. 2 the effect of the angle $\alpha$ on the inclination of the tool holder bar 32 progressively decreases, as described in the foregoing, until it becomes zero, as shown in FIG. 2. On the other hand, the effect of the inclination of the auxiliary pivot 52 in a second direction progressively increases, from the retracted position, and reaches its maximum in the operative position shown in FIG. 2. This is illustrated in FIG. 16, where the axis E of the auxiliary pivot forms an angle $\rho$ with the vertical. If this supplementary inclination of the auxiliary pivot 52 takes the direction indicated in FIG. 16 its effect will be added to that of the angle $\alpha$ on the inclination of the tool holder bar in the operative position, which will then be equal to $\alpha+\rho$. It may thus be seen that this supplementary inclination of the auxiliary pivot can be adopted, for example, when the tapholes are produced at an exceptionally steep gradient and it is not desired to forego the benefit of a low horizontal retracted position.

It is even possible for this second inclination of the auxiliary pivot to be adjustable likewise. This possibility, however, has not been illustrated in the drawings.

Needless to say, it is also possible for the auxiliary pivot to be inclined in this second direction only, i.e. for the angle $\alpha$ to be made zero.

To sum up, it may be stated that the designer of this type of machine is henceforward provided with a series of parameters which he may utilize as desired in order to assemble the machine in such a way that it will satisfy the required conditions in an optimum manner, particularly as regards its trajectory, its retracted position and its operative position. Furthermore, the machine can be adapted, even after assembly and erection, to special or even exceptional conditions, when provided with a hinge such as shown in FIGS. 5 and 6, particularly for the purpose of drilling tapholes at different levels.

We claim:

1. Apparatus for guiding and positioning a tool relative to a taphole of a shaft furnace, the taphole communicating with a pouring channel whereby molten metal may be withdrawn from the furnace, the taphole having an axis which lies in a vertical plane, the tool having a longitudinal axis, said apparatus comprising:

main pivot means, said main pivot means having a longitudinal axis which defines a first angle with respect to the vertical;

support arm means, said support arm means having a longitudinal axis and being mounted on said main pivot means for pivoting about said main pivot means axis;

guide bar means;

means coupling a first end of said guide bar means to said support arm means whereby said guide bar means will move with said support arm means during pivoting of said support arm means about said main pivot means axis;

intermediate support means, said intermediate support means being connected at a first point to said guide bar means adjacent the second end thereof;

means mounting the tool from said intermediate support means, said tool mounting means establishing a rigid connection between a second point on said intermediate support means and the tool, said rigid connection being adjustable to vary the angle of inclination of the tool axis with respect to the horizontal;

auxiliary pivot means, said auxiliary pivot means connecting a third point on said intermediate support means to a point on said support arm means which is displaced from said main pivot means, said auxiliary pivot means having an axis which is inclined in a first direction with respect to said main pivot means axis whereby said auxiliary pivot means axis defines a second angle with respect to a vertical, said second angle differing from said first angle; and means for causing said support arm means to rotate about said main pivot means axis whereby the tool will be moved between an operative position with its axis generally aligned with the taphole axis and a retracted position.

2. The apparatus of claim 1 wherein said support arm means and main pivot means longitudinal axes define a plane and wherein the axis of said auxiliary pivot means lies in said plane.

3. The apparatus of claim 2 wherein the axis of said auxiliary pivot means is further inclined in a second direction which is perpendicular to said first direction of inclination.

4. The apparatus of claim 2 wherein the connection between said intermediate support means and said guide bar means is a pivot connection.

5. The apparatus of claim 2 wherein the axis of said auxiliary pivot means diverges in the vertical direction away from said main pivot means axis.

6. The apparatus of claim 2 wherein said auxiliary pivot means axis in the vertical direction is inclined toward said main pivot means axis.

7. The apparatus of claim 1 wherein said support arm means comprises:

an elongated first support arm portion, a first end of said first portion being pivotally connected to said main pivot means, said first portion having a longitudinal axis; and a second support arm portion, said second portion extending from the second end of said first portion and having an axis which is angularly related with respect to the axis of said first portion, said auxiliary pivot means being coupled to said second portion adjacent the second end thereof and the angle between said first and second portions of said support arms means determining said second angle.

8. The apparatus of claim 7 further comprising: hinge means for connecting the second end of said support arm means first portion to the first end of said support arm means second portion whereby said second angle is adjustable, said hinge means having an axis which is oriented perpendicularly with respect to said auxiliary pivot means axis.

9. The apparatus of claim 7 wherein said support arm means and main pivot means longitudinal axes define a plane and wherein the axis of said auxiliary pivot means lies in said plane.

10. The apparatus of claim 9 wherein the axis of said auxiliary pivot means diverges in the vertical direction away from said main pivot means axis.

11. The apparatus of claim 9 wherein said auxiliary pivot means axis in the vertical direction is inclined toward said main pivot means axis.

* * * * *